US010818426B2

(12) United States Patent
Kim et al.

(10) Patent No.: US 10,818,426 B2
(45) Date of Patent: Oct. 27, 2020

(54) INDUCTOR

(71) Applicant: SAMSUNG ELECTRO-MECHANICS CO., LTD., Suwon-si, Gyeonggi-do (KR)

(72) Inventors: Mi Geum Kim, Suwon-si (KR); Byeong Cheol Moon, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 126 days.

(21) Appl. No.: 15/975,426

(22) Filed: May 9, 2018

(65) Prior Publication Data

US 2019/0066914 A1 Feb. 28, 2019

(30) Foreign Application Priority Data

Aug. 23, 2017 (KR) ..... 10-2017-0106882

(51) Int. Cl.
*H01F 27/29* (2006.01)
*H01F 27/32* (2006.01)
(Continued)

(52) U.S. Cl.
CPC ..... *H01F 27/32* (2013.01); *H01F 17/0013* (2013.01); *H01F 27/292* (2013.01);
(Continued)

(58) Field of Classification Search
CPC .. H01F 17/0013; H01F 17/0006; H01F 27/32; H01F 27/30; H01F 27/292;
(Continued)

(56) References Cited

U.S. PATENT DOCUMENTS 6,194,248 B1 * 2/2001 Amaya ..... H01F 17/0006 205/204
7,663,464 B2 * 2/2010 Yamamoto ..... H01F 17/0013 336/205
(Continued)

FOREIGN PATENT DOCUMENTS

CN 101326597 A 12/2008
CN 101763933 A 6/2010
(Continued)

OTHER PUBLICATIONS

Korean Office Action dated Sep. 3, 2018 issued in Korean Patent Application No. 10-2017-0106882 (with English translation).
(Continued)

*Primary Examiner* — Mang Tin Bik Lian
(74) *Attorney, Agent, or Firm* — Morgan, Lewis & Bockius LLP

(57) ABSTRACT

An inductor includes a body and first and second external electrodes disposed on an external surface of the body. The body includes a support member, a first coil disposed on an upper surface of the support member, and a second coil disposed on the first coil. One end of the first coil is connected to a first connection portion directly connected to a first external electrode and one end of the second coil is connected to a second connection portion directly connected to a second external electrode.

19 Claims, 6 Drawing Sheets

(51) Int. Cl.
*H01F 41/04* (2006.01)
*H01F 27/30* (2006.01)
*H01F 17/00* (2006.01)

(52) U.S. Cl.
CPC ..... *H01F 27/30* (2013.01); *H01F 41/04* (2013.01); *H01F 41/041* (2013.01)

(58) Field of Classification Search
CPC ..... H01F 27/2804; H01F 27/29; H01F 2017/048; H01F 2017/0073; H01F 2017/002; H01F 2027/2809
USPC ..... 336/200, 192, 223, 232
See application file for complete search history.

(56) References Cited

U.S. PATENT DOCUMENTS 8,174,349 B2* 5/2012 Yoshida ..... H01F 27/292 257/700
8,248,200 B2 8/2012 Ishimoto et al.
8,482,371 B2 7/2013 Jeong et al.
2004/0164835 A1* 8/2004 Shoji ..... H01F 17/0013 336/200
2005/0068150 A1* 3/2005 Matsutani ..... H01F 17/04 336/223
2007/0030108 A1* 2/2007 Ishimoto ..... H01F 10/14 336/200
2008/0303622 A1 12/2008 Park et al.
2010/0157565 A1 6/2010 Yoshida et al.
2010/0182116 A1* 7/2010 Ishimoto ..... H01F 17/0006 336/192
2010/0219925 A1* 9/2010 Yamamoto ..... H01F 17/0013 336/199
2012/0274432 A1* 11/2012 Jeong ..... H01F 27/2804 336/192
2013/0141206 A1* 6/2013 Lee ..... H01F 17/0006 336/200
2013/0222101 A1* 8/2013 Ito ..... H01F 5/003 336/83
2013/0333202 A1 12/2013 Lee et al.
2014/0002226 A1* 1/2014 Moon ..... H01F 41/125 336/200
2014/0062643 A1 3/2014 Hahn et al.
2014/0133107 A1* 5/2014 Chang ..... H01F 17/0013 361/748
2014/0145797 A1* 5/2014 Bae ..... H01F 17/0013 333/185
2015/0042439 A1* 2/2015 Matsushita ..... H01F 17/0013 336/200
2015/0325363 A1* 11/2015 Chang ..... H01F 17/04 336/192
2015/0380151 A1* 12/2015 Choi ..... H01F 41/041 336/200
2016/0012961 A1* 1/2016 Suzuki ..... H01F 27/2804 336/192

FOREIGN PATENT DOCUMENTS

CN 102760553 A 10/2012
JP H11-204337 A 7/1999
JP 2013-153184 A 8/2013
KR 10-0862489 B1 10/2008
KR 10-2012-0122589 A 11/2012
KR 10-2014-0002355 A 1/2014
KR 10-2014-0024151 A 2/2014
KR 10-2014-0028392 A 3/2014
KR 10-2016-0137146 A 11/2016
KR 10-1709810 B1 3/2017

OTHER PUBLICATIONS

Chinese Office Action dated Aug. 24, 2020 issued in Chinese Patent Application No. 201810820031.X (with English translation).

* cited by examiner

INDUCTOR

CROSS-REFERENCE TO RELATED APPLICATION

This application is based on and claims the benefit of priority to Korean Patent Application No. 10-2017-0106882 filed on Aug. 23, 2017 in the Korean Intellectual Property Office, the entire disclosure of which is incorporated herein by reference.

TECHNICAL FIELD

The present disclosure relates to an inductor and, more particularly, to a high frequency inductor.

BACKGROUND

Reductions in mounting areas due to the continuous miniaturization and multifunctionalization of mobile devices as well as the appearance of new wearable devices require smaller passive components. Among such passive components, a high frequency inductor, as a matching element, is required to realize precise inductance. The high frequency inductor, although compact, is required to have a high Q factor, as well as precisely adjusted inductance.

Korean Patent Laid-Open Publication No. 10-2014-0028392 discloses a multilayer high frequency inductor including a ceramic body, which is formed by punching a via connecting electrodes and each layer to a plurality of magnetic layers formed of ceramics and subsequently printing a pattern.

SUMMARY

An aspect of the present disclosure may provide an inductor including a coil having a high aspect ratio to ensure low direct current (DC) resistance and realizing a high Q factor in a high frequency region.

According to an aspect of the present disclosure, an inductor may include: a body; first and second external electrodes disposed on an external surface of the body. The body includes: a support member, a first coil disposed on an upper surface of the support member, a second coil disposed on the first coil, a first insulating layer and a second insulating layer embedding the first coil and the second coil, respectively, a first connection portion connected to a first end of the first coil, and a second connection portion connected to a first end of the second coil.

The first and second connection portions may be disposed on a first side surface and a second side surface of the support member opposing each other in a length direction of the support member, and directly connected to the first and second external electrodes, respectively.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

Hereinafter, an inductor according to an exemplary embodiment in the present disclosure will be described, but is not limited thereto.

Figure 1:
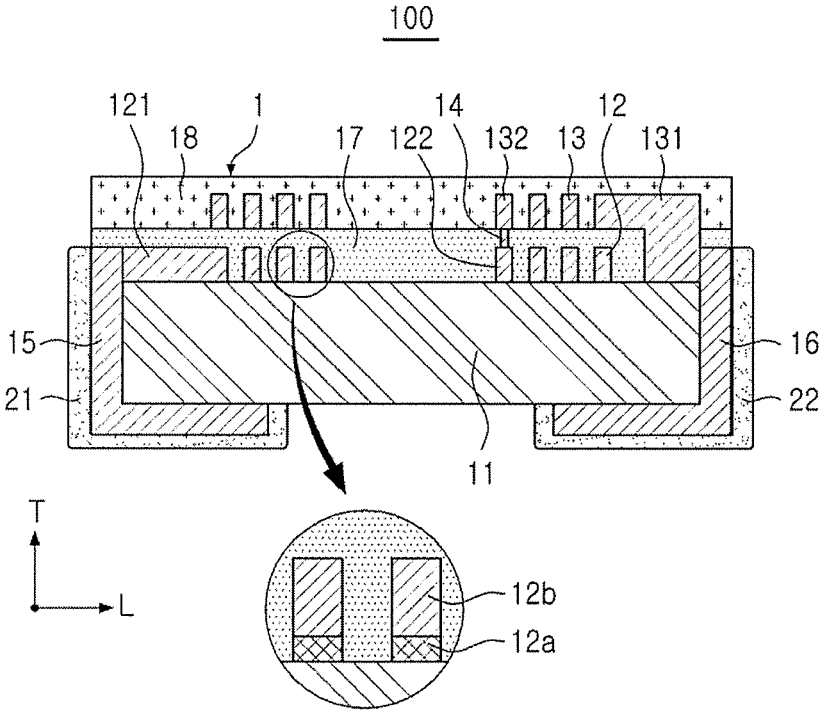
FIG. 1 is schematic cross-sectional view of an inductor according to an exemplary embodiment in the present disclosure.

FIG. 1 is a cross-sectional view of an inductor according to an exemplary embodiment in the present disclosure. Referring to FIG. 1, an inductor 100 according to an exemplary embodiment in the present disclosure includes a body 1 and first and second external electrodes 21 and 22.

The body 1 includes a support member 11, a first coil 12 disposed on an upper surface of the support member 11, and a second coil 13 disposed above the first coil 12. The body 1 has an upper surface and a lower surface opposing each other in the thickness direction T, a first surface and a second surface opposing each other in the length direction L, and a third surface and a fourth surface opposing each other in the width direction W, forming a chip having a substantially hexahedral shape but is not limited thereto.

The support member 11 is not limited as long as it is a material having insulating properties, and a person skilled in the art may appropriately select a material according to design conditions or required characteristics. For example, a material containing glass fiber, a build-up film formed of only prepreg (PPG) or resin, or a PID may be used as a material of a central core of a general copper clad laminate.

The support member 11 may be a thin plate having a uniform thickness of about 20 to 100 μm on the whole.

The first coil 12 includes a plurality of coil patterns connected to each other and has a spiral shape as a whole, but is not limited thereto. The first coil 12 has a first end 121 and a second end 122. The first end 121 is connected to a first connection portion 15 and the second end 122 is connected to a via 14 connecting the first and second coils 12 and 13. For the purposes of description, the first end 121 of the first coil 12 and the first connection portion 15 are illustrated as separate components, but the first end 121 of the first coil 12 and the first connection portion 15 are continuously integrally configured and are substantially indistinguishable from each other in terms of appearance. Similarly, a first end 131 of the second coil 13 (to be described hereinafter) and a second connection portion 16 connected thereto are illustrated as separate components, but the second end 131 of the first coil 12 and the second connection portion 16 are continuously integrally configured and are substantially indistinguishable from each other in terms of. In particular, since the first and second connection portions 15 and 16 are formed through the same process as that of a seed layer disposed below the first and second coils 12 and 13, the first and second connection portions 15 and 16 are substantially completely integrated with the seed layer.

A structure of the first coil 12 will be described in detail with reference an enlarged view of the region A of FIG. 1. The first coil 12 includes the seed layer 12*a* in direct contact with an upper surface of the support member 11 and a coil layer 12*b* disposed on the seed layer 12*a*. Shapes of L-W cross-sections of the seed layer 12*a* and the coil layer 12*b* match each other and this may be referred to a method of forming the coil layer as described hereinafter. Both the seed layer 12*a* and the coil layer 12*b* include a conductive material and may be formed of the same material or different materials. The seed layer 12*a* and the coil layer 12*b* may include at least one of copper (Cu), titanium (Ti), nickel (Ni), tin (Sn), aluminum (Al), and molybdenum (Mo), and in order to form the seed layer 12*a* and the seed layer 12*b*, any one of a wetting method (chemical plating) or a drying method (sputtering) may be appropriately selected.

Next, referring to the second coil 13 connected to the first coil 12 through a via, the second coil 13 includes a plurality of coil patterns connected to each other and has a spiral shape as a whole, but is not limited thereto. The second coil 13 also includes a plurality of coil patterns and each coil pattern includes a seed layer and a coil layer.

The first end 131 of the second coil 13 is connected to the second connection portion 16 and a second end 132 thereof is connected to the via 14.

Since the via 14 electrically connects the first and second coils 12 and 13, the via may be formed of a material having excellent conductivity. A cross-section of the via may have a circular, oval, or polygonal shape, and may have a combination of a tapered shape and an inversely tapered shape to have a smallest cross-sectional area at a central portion thereof as a whole.

Next, a first insulating layer 17 embedding the first coil 12 and a second insulating layer 18 embedding the second coil 13 will be described. The first and second insulating layers 17 and 18 are formed of a non-conductive resin. For example, the first and second insulating layers 17 and 18 may be formed of a resin composition including an epoxy, a resin material (non-conductive film) in which a material for adjusting hardness such as a filler, or the like, is rarely added, as an NCF, or a build-up resin as an epoxy resin containing a filler, or a resin material called an anisotropic conductive film (ACF). A material thereof is not limited and a person in the art may appropriately select a material. Also, in a method of forming the first and second insulating layers 17 and 18, a photosensitive film may be used, or an insulating layer may be applied only to a portion where an inductor chip is to be formed by a printing method. In this case, chip loss due to damage to the insulating layer when dicing is performed in units of chips may be minimized. The first insulating layer 17 may embed the first coil 12, fill spaces between the plurality of coil patterns included in the first coil 12, or may fill a core of the first coil 12. Similarly, the second insulating layer 18 may embed the second coil 13 and fill spaces between the plurality of coil patterns included in the second coil 13. At least a portion of a side surface of the first insulating layer 17 and at least a portion of a side surface of the second insulating layer 18 are not covered by the first and second external electrodes 21 and 22 and external surfaces of the first and second insulating layers 17 and 18 may be exposed as is to realize an appearance of the body 1.

Next, referring to the first connection portion 15 and the second connection portion 16, the first and second connection portions 15 and 16 are respectively disposed on a first side surface and a second side surface opposing each other in the length direction of the support member 11 and are in direct contact with the first and second side surfaces. External surfaces in which the first and second connection portions 15 and 16 are in contact with the first and second external electrodes 21 and 22, respectively, include a surface on which a cutting step has been completed, for example, through a dicing blade. In order to indicate portions of the external surfaces of the first and second connection portions 15 and 16 in contact with the first and second external electrodes 21 and 22 cut through the cutting step, other than the external surfaces of the first and second connection portions 15 and 16 in contact with the support member 11, the portions of the external surfaces of the first and second connection portions 15 and 16 are indicated by the thick dotted line. Since the first and second connection portions 15 and 16 are already disposed between the support member 11 and the first and second external electrodes 21 and 22, a separate pre-treatment for forming the external electrode is not required. For example, a pre-treatment of copper wire plating, or the like, is unnecessary. Thus, after the inductor 100 is diced into chip units, external electrode plating is performed immediately to form a plating layer containing nickel and tin. The first and second connection portions 15 and 16 extend from the first and second side surfaces of the support member 11 to a portion of the upper surface and/or a lower surface of the support member 11. Substantially, portions of the first and second connection portions 15 and 16 extending to portions of an upper surface of the support member 11 are integrally connected to the first end 121 of the first coil 12 and the first end 131 of the second coil 13 to constitute part of the first coil 12.

Next, the first and second external electrodes 21 and 22 are disposed on a first side surface and a second side surface of the body 1, respectively, and cover external surfaces of the first connection portion 15 and the second connection portion 16 described above, respectively. The first and second external electrodes 21 and 22 are separated from the support member 11 and are in contact with the first and second connection portions 15 and 16 formed of a conductive material therebelow, and thus, the first and second external electrodes 21 and 22 may be immediately formed as plating layers such as Ni, Sn, and the like. Upper surfaces of the first and second external electrodes 21 and 22 are illustrated as being in the same position as an upper surface of the first coil 12, but may also extend to at least a portion of a side surface of the first insulating layer 17, to a position higher than the upper surface of the first coil 12, to embed the first coil 12. The upper surfaces of the first and second external electrodes 21 and 22 may extend to a position lower than a lower surface of the second coil 13. The first and second external electrodes 21 and 22 cover external surfaces of the first and second connection portions 15 and 16, and here, it is important to cover lower regions of the first and second connection portions 15 and 16. That is, when a mounting surface of the inductor 100 is disposed to face a printed circuit board (PCB), a lower surface of the support member 11 is not in contact with the PCB, and lower surfaces of the first and second connection portions 15 and 16 and lower surfaces of the first and second external electrodes 21 and 22 covering the lower surfaces of the first and second connection portions 15 and 16 are disposed below the lower surface of the support member 11. As a result, a distance between the first and second coils 12 and 13 disposed only on an upper surface of the support member 11 and the PCB is significantly increased to result in frequent disconnection of magnetic flux to increase a Q factor.

Hereinafter, a manufacturing process of the inductor 100 of FIG. 1 will be described with reference to FIG. 2

First, a copper clad laminate (CCL) 3' generally used as a substrate of a thin film type inductor is prepared (FIG. 2(*a*)). A first through hole 3*h* and a second through hole 3*h* are prepared in positions spaced apart from each other by a predetermined distance on the left and right with respect to the center of the CCL, respectively, and Cu thin film layers on the upper and lower surfaces of the CCL are removed (FIG. 2(*b*)). Upper and lower surfaces of the CCL 3 (hereinafter, CCL refers to a CCL in which the Cu thin film layers on the upper and lower surfaces have been removed and only a core remains) and the already formed through holes are filled, and the upper surface and the lower surface of the CCL 3 are plated 31 so that the upper and lower surfaces of the CCL are electrically connected to each other (FIG. 2(*c*)). Here, a material for filling the through holes may be appropriately selected by a person skilled in the art and may be the same as a material used for plating 31 or may be different. Meanwhile, as shown in FIG. 2C, when the through holes are filled, plating may be performed on the upper and lower surfaces of the CCL through a separate process after the through holes are filled, or alternately, although not shown specifically, a method of simultaneously plating the upper and lower surfaces of the CCL so as to be continuously connected to side surfaces of the through holes may also be applicable. Thereafter, portions of the plating layers on the upper and lower surfaces of the CCL are etched to form a seed layer 31*a* (FIG. 2D). Here, a material of the seed layer 31*a* is not limited to Cu, and, for example, Ti, Ni, and the like, may be appropriately selected by a person skilled in the art, and thus, a degree of freedom of selecting a material of the seed layer 31*a* is high. A resist 4 patterned on upper and lower surfaces of the seed layer 31*a* is prepared (FIG. 2E). Plating 31*b* is performed to fill openings of the resist (FIG. 2F). A thickness of the plating is smaller than a thickness of the resist. This is because, if the plating is formed to be thicker than the resist, a short may occur between the adjacent plated patterns. Here, in case where plating is formed to be thicker than the resist, planarization may be performed through a separate lapping method, or the like.

Figure 2A:
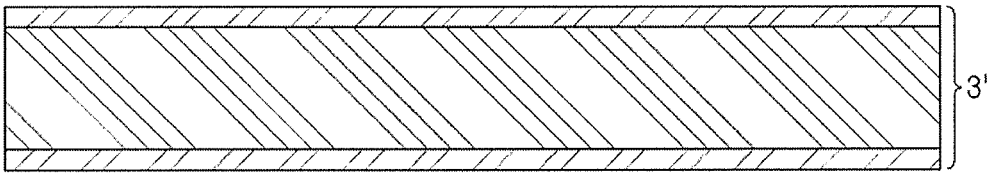
FIGS. 2A through 2O are cross-sectional views schematically illustrating a sequential process of a method of manufacturing the inductor of FIG. 1.
Figure 2B:
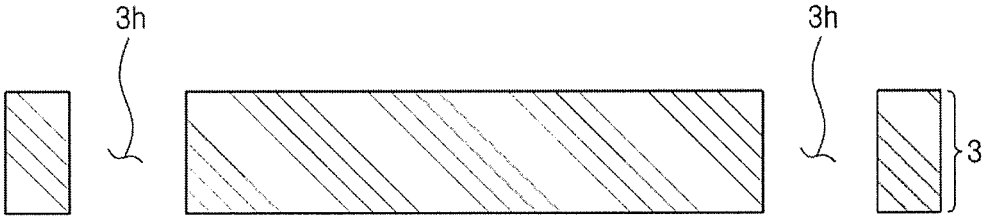
Figure 2C:
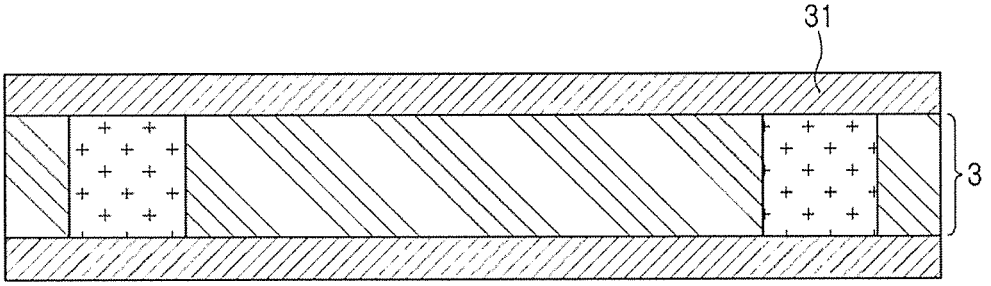
Figure 2D:
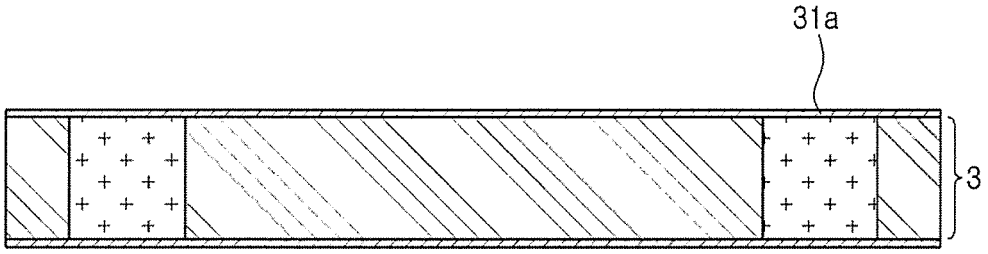
Figure 2E:
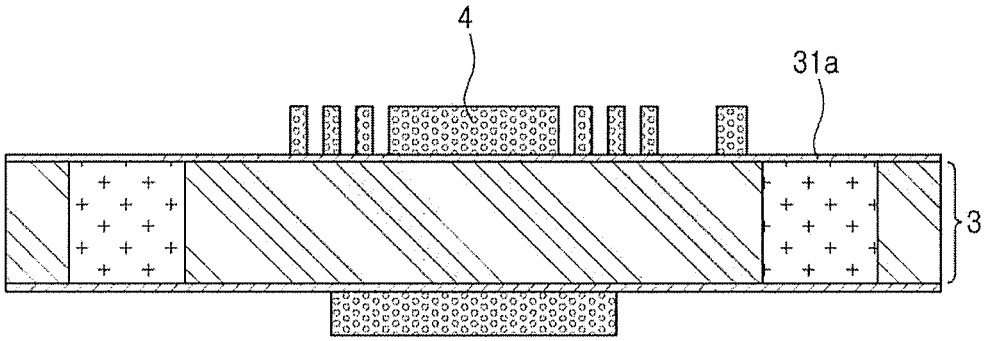
Figure 2F:
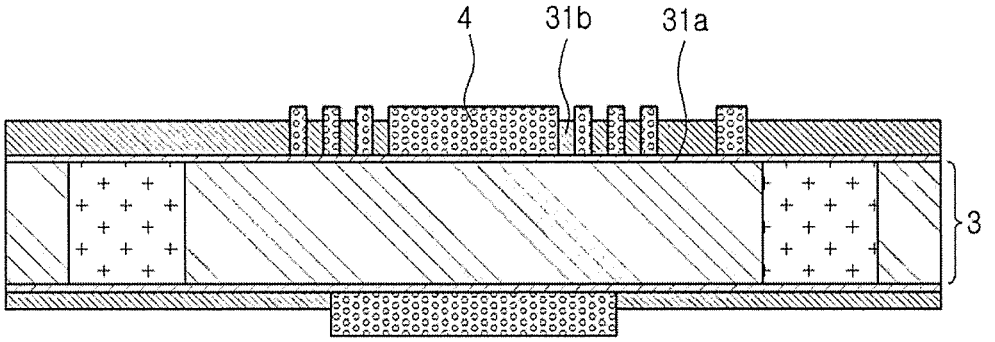
Figure 2G:
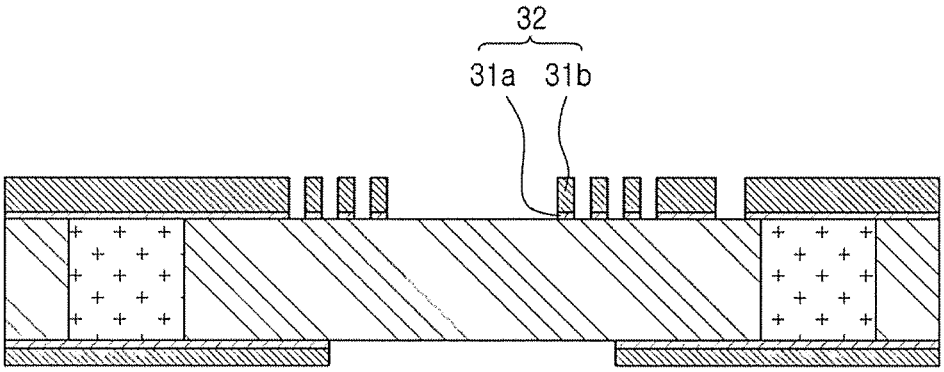
Figure 2H:
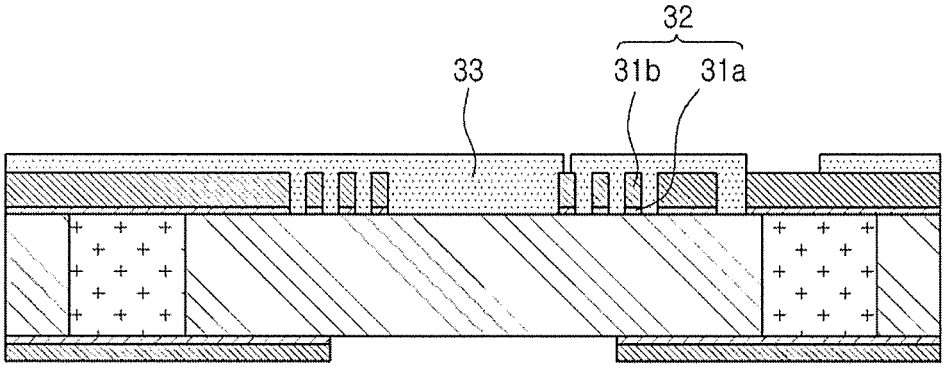
Figure 2I:
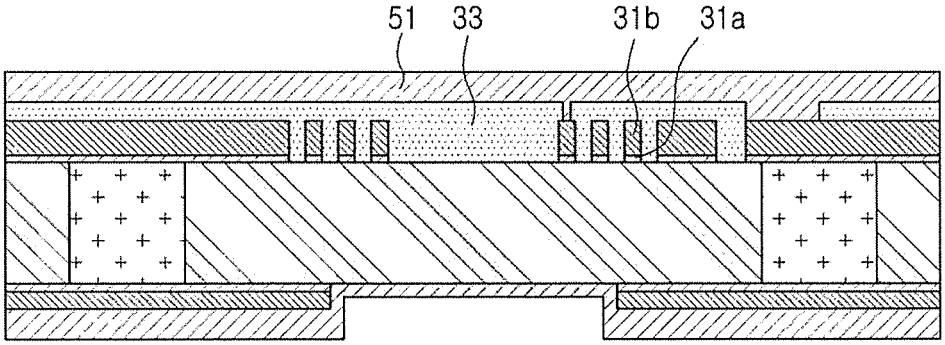
Figure 2J:
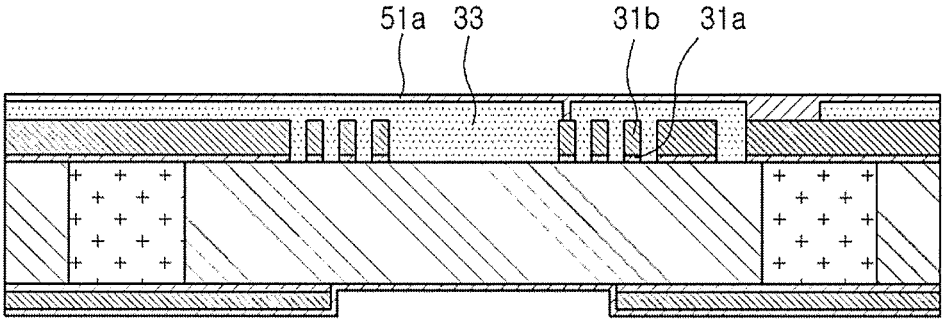
Figure 2K:
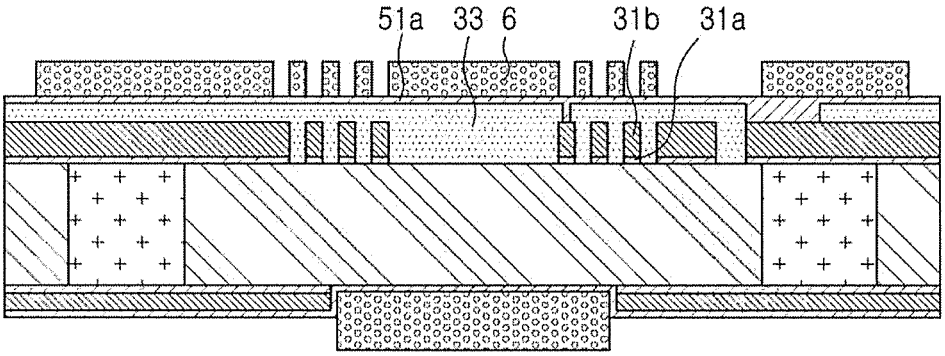
Figure 2L:
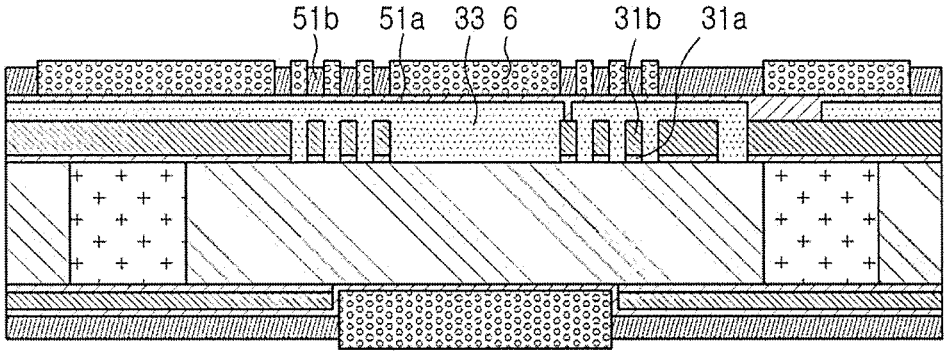
Figure 2M:
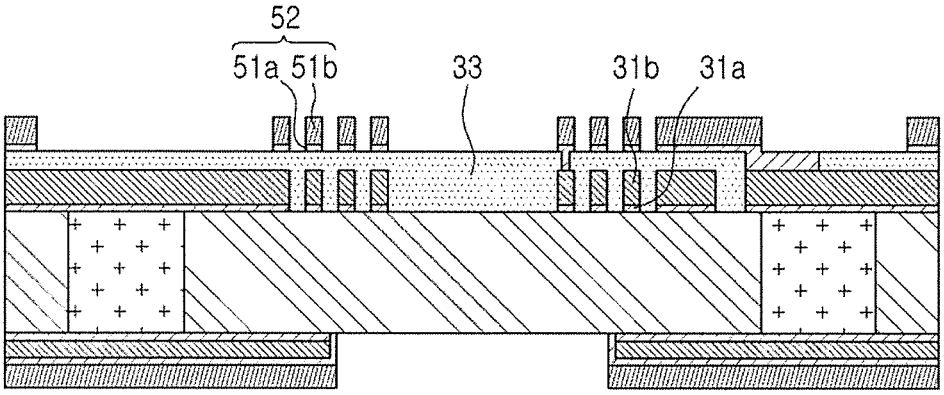
Figure 2N:
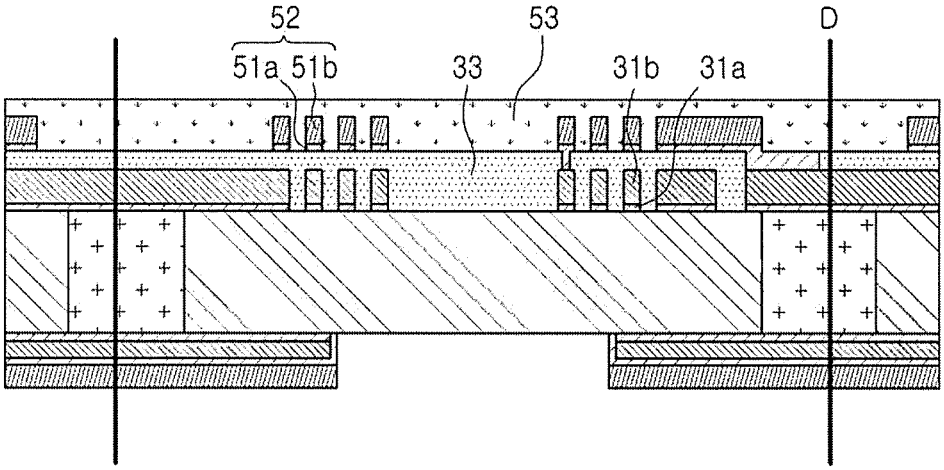
Figure 2O:
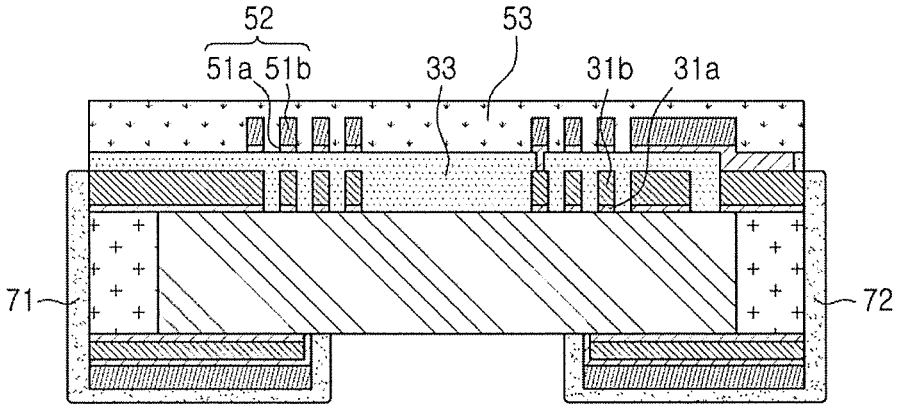

Thereafter, the resist is removed and the seed layer under the resist is also removed (FIG. 2G). In order to remove the resist, both a delamination method using wetting and a dry delamination method using laser may be used and is not limited thereto. When the resist and the seed layer under the resist are removed, the first coil 32 including the seed layer and the plating layer on the seed layer is formed. In order to embed the first coil 32, a first insulating layer 33 is stacked and cured and via hole processing for interlayer connection of upper and lower coils is performed (FIG. 2H). Here, a portion of the first insulating layer in a position spaced apart from a position of the same plane of the via hole by a predetermined distance in the length direction is etched to form a connection portion. Thereafter, plating 51 is performed to fill the via hole and stacked on the first insulating layer. Here, the inside of the connection portion formed in step 2H is filled (FIG. 2I). A portion of the plating is etched to form a seed layer 51*a*. Here, in order to form the seed layer, a method of performing etching after plating may be selected, but is not limited thereto and a method of forming the seed layer immediately without performing plating may also be selected (not shown) (FIG. 2J). Thereafter, a patterned resist 6 having an opening is formed on the seed layer 51*a* (FIG. 2K). Also, plating 51*b* is performed to fill the opening of the resist (FIG. 2L). Also, in this case, similarly to the formation of the first coil, a thickness of the plating is smaller than a thickness of the resist. Thereafter, the resist 6 and the seed layer under the resist 6 are removed to form a second coil 52 (FIG. 2M). In order to embed the second coil, a second insulating layer 63 is stacked and cured (FIG. 2N). Thereafter, a certain point within the through hole prepared in FIG. 2B is cut through a dicing blade D to form an individual chip (FIG. 2O). Thereafter, a plating process is immediately performed as a general external electrode formation process to form first and second external electrodes 71 and 72.

Redundant descriptions of features of the inductor according to an exemplary embodiment in the present disclosure, except for the above description, will be omitted here.

In the case of the aforementioned inductor, since the coil is formed only on the upper surface of the support member, when the inductor is mounted, the coil is positioned to be significantly spaced apart from land, disconnection of magnetic flux rarely occurs, obtaining a high Q factor. Also, since the through hole is formed in the support member, a portion of plating filling the through hole is diced, and the remaining plating layer is directly connected to the external electrode, plating for the external electrode may be immediately performed without separate preparation to form the external electrode, obtaining user convenience. Also, after the inductor is mounted on a PCB, electrical connectivity between the inductor and the PCB and connection stability are excellent. Also, since the dry film resist is used to form the plurality of layers of coil patterns, the coil having a high aspect ratio may be obtained, and since a large magnetic path area is secured in a central portion of the coil, high capacity may be realized. In addition, since alignment for connecting interlayers of the coil pattern is actually made only through one via, very precise inductance distribution may be secured.

As set forth above, according to exemplary embodiments of the present disclosure, the high frequency inductor which is compact and has a high Q factor, while including the coil having a high aspect ratio, may be provided.

While exemplary embodiments have been shown and described above, it will be apparent to those skilled in the art that modifications and variations could be made without departing from the scope of the present invention as defined by the appended claims.

What is claimed is:

1. An inductor comprising:

a body; and first and second external electrodes disposed on an external surface of the body, wherein the body includes:

a support member;

a first coil disposed on an upper surface of the support member;

a second coil disposed on the first coil;

a first insulating layer and a second insulating layer embedding the first coil and the second coil, respectively;

a first connection portion connected to a first end of the first coil; and a second connection portion connected to a first end of the second coil, and the first and second connection portions are disposed on a first side surface and a second side surface of the support member opposing each other in a length direction of the support member, and directly connected to the first and second external electrodes, respectively, at least one of a lowermost surface of the first connection portion or a lowermost surface of the second connection portion is arranged lower than a lowermost surface of the supporting member opposite the upper surface, the first and second external electrodes are arranged to cover the lowermost surfaces of the first and second connection portions, respectively, and the first and second connection portions each include a seed layer disposed on the support member and a plating layer disposed on the seed layer.

2. The inductor of claim 1, wherein the first and second external electrodes entirely cover the first and second connection portions, respectively.

3. The inductor of claim 1, wherein the first coil and the second coil are connected through a via, and the via is connected to a second end of the first coil and a second end of the second coil.

4. The inductor of claim 3, wherein an upper surface of the via is coplanar with an upper surface of the first insulating layer.

5. The inductor of claim 1, wherein at least a portion of a surface of the first connection portion in contact with the first external electrode is a flat surface, and at least a portion of a surface of the second connection portion in contact with the second external electrode is a flat surface.

6. The inductor of claim 1, wherein the first connection portion and the first end of the first coil are integrally connected.

7. The inductor of claim 1, wherein the second connection portion and the first end of the second coil are integrally connected.

8. The inductor of claim 1, wherein the first and second external electrodes extend to a position which is the same as an upper surface of the first coil or to a position higher than the upper surface of the first coil, with respect to a thickness direction of the support member.

9. The inductor of claim 8, wherein the first and second external electrodes extend to a position lower than a lower surface of the second coil, with respect to the thickness direction of the support member.

10. The inductor of claim 1, wherein a lower surface of the support member is positioned to be higher than lower surfaces of the first and second external electrodes, with respect to a thickness direction of the support member.

11. The inductor of claim 1, wherein the first and second coils each include a seed layer and a coil layer disposed on a respective seed layer of the first and second coils.

12. The inductor of claim 11, wherein the seed layer and the coil layer of each of the first and second coils each have a spiral shape as a whole to correspond to each other, and a width of the seed layer and a width of the coil layer of each of the first and second coils are equal.

13. The inductor of claim 11, wherein a material of the seed layer of the first coil or the second coil is the same as a material of the first and second connection portions.

14. The inductor of claim 11, wherein the seed layer of the first coil and portions of the first connection portion disposed on the first side surface of the support member are connected to each other.

15. The inductor of claim 1, wherein the support member is a thin plate formed by removing copper layers from upper and lower surfaces of a copper clad laminate (CCL).

16. The inductor of claim 1, wherein the first and second connection portions extend from the first side surface and the second side surface of the support member opposing each other to at least a portion of the lower surface of the support member.

17. The inductor of claim 1, wherein the first and second external electrodes and the support member are disposed to be physically separated.

18. The inductor of claim 1, wherein the at least one of the lowermost surface of the first connection portion or the lowermost surface of the second connection portion is arranged in a region between the lowermost surface of the supporting member and a respective one of the first and second external electrodes a thickness direction of the support member.

19. The inductor of claim 1, wherein the first and second external electrodes are arranged to entirely enclose the lowermost surfaces of the first and second connection portions, respectively.

* * * * *